US005347083A

United States Patent [19]

Suzuki et al.

[11] Patent Number: 5,347,083

[45] Date of Patent: Sep. 13, 1994

[54] AUTOMATIC PERFORMANCE DEVICE HAVING A FUNCTION OF AUTOMATICALLY CONTROLLING STORAGE AND READOUT OF PERFORMANCE DATA

[75] Inventors: Satoshi Suzuki; Takashi Ikeda, both of Hamamatsu, Japan

[73] Assignee: Yamaha Corporation, Japan

[21] Appl. No.: 96,608

[22] Filed: Jul. 23, 1993

[30] Foreign Application Priority Data

Jul. 27, 1992 [JP] Japan ..... 4-218766

[51] Int. Cl.[5] ..... G10H 1/38; G10H 7/00

[52] U.S. Cl. ..... 84/613; 84/637; 84/DIG. 22

[58] Field of Search ..... 84/609-614, 84/634-638, DIG. 22

[56] References Cited

FOREIGN PATENT DOCUMENTS 58-220189 12/1983 Japan .

*Primary Examiner*—Stanley J. Witkowski

*Attorney, Agent, or Firm*—Graham & James

[57] ABSTRACT

A memory has plural storage areas for storing performance data of plural music pieces. When the player has input desired performance data via an input device like a keyboard, the thus-input performance data are automatically stored into a first storage area of the memory. At the same time, a specific search is executed by the search section to examine whether or not performance data of a music piece corresponding to the input performance data are already stored in the memory. If a second storage area storing the performance data corresponding to the input performance data has been detected or searched out, a series of the performance data stored in the second storage area are sequentially read out for an automatic reproductive performance. If, on the other hand, such a second storage area has not been detected, writing of the input performance data into the first storage area is continued without such an automatic reproductive performance being executed. Therefore, it is sufficient for the player to perform an operation to input a part or whole part of the desired music piece. Then, in response to the player's input operation, music piece number selection and readout or write processes are automatically carried out in accordance with the result of the search by the search section.

7 Claims, 6 Drawing Sheets

AUTOMATIC PERFORMANCE DEVICE HAVING A FUNCTION OF AUTOMATICALLY CONTROLLING STORAGE AND READOUT OF PERFORMANCE DATA

BACKGROUND OF THE INVENTION

The present invention relates to an automatic performance device such as a sequencer, automatic bass chord accompaniment device or automatic rhythm performance device, and more particularly to an automatic performance device which is capable of facilitating performance data storage and retrieval.

Automatic performance devices are known which store, as automatic performance data, such performance data produced, for example, by the manual operation (key depression) on a keyboard of an electronic musical instrument and generate tones by sequentially reproducing the thus-stored automatic performance data.

In the conventional automatic performance devices, performance data of dozens of music pieces can be stored in a performance memory, and desired performance data are reproduced by suitably operating switches provided on a operation panel.

Typically, the performance memory has plural storage areas in such a manner that the performance data of a different music piece can be stored in each of the storage areas. Typically, to store the performance data, a write instructing switch is operated, and a predetermined input operation is made to instruct a desired music piece number. In response to such operations, series of performance data input via the keyboard are written into a storage area corresponding to the instructed music piece number. To reproductively read out the performance data, a predetermined reproduction instructing switch is operated, and a predetermined operation to instruct a desired music piece number is made. In response to such operations, a series of the performance data are read out from the storage area corresponding to the instructed music piece number, and automatic performance tones are generated on the basis of the read-out performance data.

However, the typical conventional technique for writing and reading out the performance data is disadvantageous in that it requires the troublesome switch operations to instruct the write and readout of the data. Further, for reproductively reading out the performance data, it is necessary to accurately instruct the number of a desired music piece from among many music piece numbers, which is also troublesome. Namely, it is difficult or impossible to remember the numbers of all music pieces to be selectively read out from among the dozens of the stored music pieces: if the number of a desired music piece is forgotten, it is not possible to easily designate the desired music piece.

In Japanese Patent Laid-open Publication No. 58-220189, there is disclosed a technique which allows a desired music piece to be easily searched out from among many music pieces stored in a performance data memory. More specifically, according to the disclosed technique, performance data on a leading phrase of a desired music piece are input by the player's key depression operation on a keyboard, and it is detected in which part of the data memory the desired music piece is stored by making a comparison between the input performance data and the performance data on the leading phrase of each of the plural music pieces stored in the data memory. However, this prior publication only discloses a technique for searching the performance data in the performance data memory, but it discloses nothing about writing desired performance data into a memory and minimizing the time and labors required for making write and readout instructions in writing and reading desired performance to and from the memory. In particular, the prior publication discloses nothing about storing the input performance data from the keyboard into the performance data memory. Further, with the disclosed technique, it is necessary to operate a search switch each time it is desired to search for a music piece number in the performance data memory, and it is also necessary to operate a start switch each time it is desired to start a reproductive performance of the searched out music piece. As the result, the switch operations must be repeated many times for repeating the search and reproductive performance.

Summary of the Invention

It is therefore an object of the present invention to provide an automatic performance device which allows a desired music piece to be easily searched out and reproduced without requiring any troublesome switch operations and also allows a desired music to be stored without requiring any troublesome switch operations.

To achieve the above-mentioned object, an automatic performance device in accordance with the present invention comprises a storage section having a plurality of storage areas, each of the storage areas storing a series of performance data corresponding to a music piece, thereby the storage section being capable of storing performance data of plural music pieces, an input section for inputting desired performance data, a write-control section for controlling write of the performance data input by the input section, into a first storage area of the storage section, a search section for making a comparison between the performance data already stored in storage areas of the storage section other than the first storage area and the input performance data, in order to detect whether or not performance data of a music piece corresponding to the input performance data are already stored in the storage section, and also for detecting, on the basis of the result of the comparison, a second storage area of the storage where performance data of a music piece corresponding to the input performance data are stored, and a performance control section for, if the second storage area has been detected, sequentially reading out a series of performance data from the second storage area.

When the player has input desired performance data via the input section (for example, keyboard), the input performance data are written into the first storage area of the storage section in an automatic manner. At the same time, search is made by the search section to examine whether or not performance data of a music piece corresponding to the input performance data are already stored in the storage section. If a second storage area storing the performance data corresponding to the input performance data has been detected or searched out, a series of the performance data stored in the second area are sequentially read out therefrom by the performance control section for a reproductive performance. If, on the other hand, such a second storage area has not been detected, writing of the input performance data into the first storage area is continued, with result that the desired performance data are written for storage.

Therefore, the player only has to make such an operation to input a part or whole part of the desired music piece. Namely, in order to read out a desired music piece already stored, it is sufficient to input a part of the performance data of the desired music. The search section then detects the input performance data, and the performance data of the desired music piece are read out for reproduction. In order to store performance data of a new music piece, it is sufficient to input the entire part of the performance data. Then, the input performance data are stored into the storage section without the data being searched for by the search section. Accordingly, the player does not have to make any of write and readout instructing operations and music piece number selection instructing operation. In response to the player's performance operation to input a part or whole part of performance data of a desired music piece, the required music piece number selection and readout or write process are executed in an automatic fashion. This conveniently eliminates the time and labors for the above-mentioned operations.

Now, the preferred embodiment of the present invention will be described in greater detail with reference to the drawings appended hereto.

DETAILED DESCRIPTION OF THE PREFERRED EMBODIMENT

Figure 1:
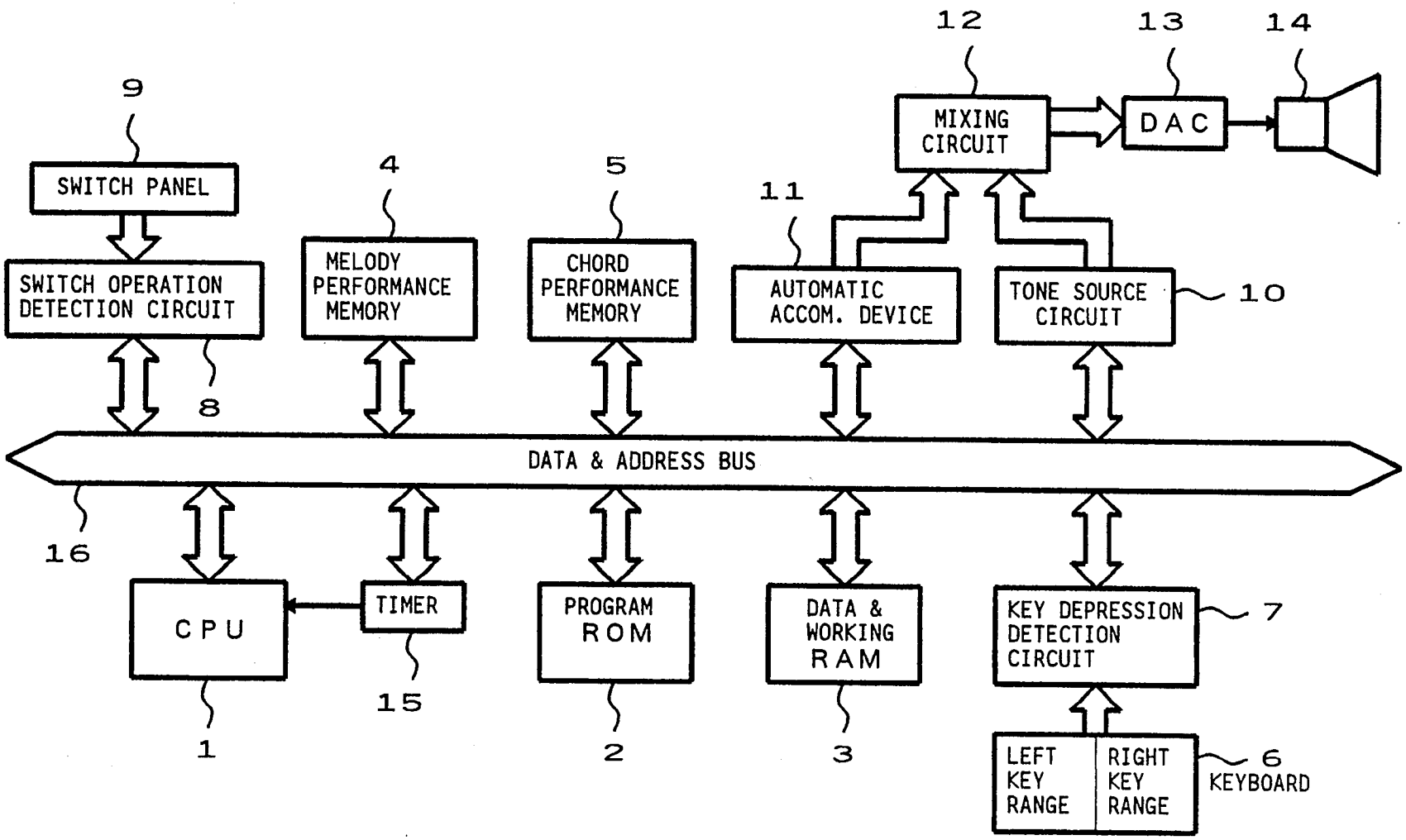
FIG. 1 is a block diagram illustrating a hardware structure of an embodiment of an electronic musical instrument to which an automatic performance device in accordance with the present invention is applied.

FIG. 1 is a block diagram illustrating a hardware structure of an embodiment of an electronic musical instrument to which an automatic performance device in accordance with the present invention is applied. In this embodiment, various processes are carried out under the control of a microcomputer which comprises a microprocessor unit (hereinafter referred to as "CPU") 1, a read-only memory (hereinafter referred to as "ROM") 2 having programs stored therein and a random-access memory (hereinafter referred to as "RAM") 3 that is used as a data and working storage.

Here in this embodiment, description will be made on such an electronic musical instrument in which various processes such as a key depression detection process and an automatic performance process are carried out by means of a single CPU 1.

The CPU 1 is designed for controlling the entire operation of the electronic musical instrument. To this CPU 1 are connected, via a data and address bus 16, the data and working RAM 3, a melody performance memory 4, a chord performance memory 5, a key depression detection circuit 7, a switch operation detection circuit 8, a tone source circuit 10, an automatic accompaniment device 11 and a timer 15.

The program ROM 2 stores therein the system program for execution by the CPU 1, parameters for generating tones and various other data.

The data and working RAM 3 is designed for temporarily storing various data and flags that are produced as the CPU 1 carries out the program, and the RAM 3 is reserved in a predetermined address region of a RAM.

The melody performance memory 4 stores therein performance data such as tone generation timing, pitch and duration of a multiplicity of notes making up the respective melody parts of plural music pieces. It is assumed in this embodiment that performance data for 20 music pieces are stored in the melody performance memory 4.

In corresponding relations to the performance data stored in the melody performance memory 4, the chord performance memory 5 stores therein data indicative of chords accompanying (progressing with) the performance data, in the form of the root and type of chord.

A keyboard 6 has a plurality of keys for designating the pitch of a tone to be generated and a plurality of key switches corresponding to the keys. The keyboard 6 may also include a key-touch detection means such as a key depression intensity detection device, as occasion may demand. The keyboard 6 is generally divided into the right and left key ranges, boundary between of which is defined by a predetermined key. It is ordinary that the right key range is used by the player for a melody performance and the left key range is used for a chord performance; therefore in this embodiment, performance data resulting from a performance operation on the right key range is detected and stored into the melody performance memory 4 as melody-related performance data and performance data resulting from a performance operation on the left key range is detected and stored into the chord performance memory 5 as chord-related performance data. This embodiment employs the keyboard 6 because it is a typical fundamental performance operator, but any other performance operator may of course be employed.

The key depression detection circuit 7 includes a key switch circuit that is provided in corresponding relations to the plural keys of the keyboard 6. This key depression detection circuit 7 generates a key-on event signal upon detection of a change from a key-released state of the keyboard 6 to a key-depressed state and also generates a key-off event signal upon detection of a change from a key-depressed state of the keyboard 6 to a key-released state. The key depression detection circuit 7 generates a key code (note number) signal which is indicative of the pitch of a key associated with each key-on event or key-off event. The key depression detection circuit 7 further detects the velocity and intensity of each key depression operation to generate detection data as velocity data and after-touch data.

A switch panel 9 includes various kinds of operators (switches) for selecting, setting and controlling the tone color, volume, pitch, effect etc. of a tone to be generated.

The switch operation detection circuit 8, which is provided in corresponding relations to the above-mentioned operators on the switch panel 9, outputs, as event information, operation data corresponding to the operation state of each of the operators.

The tone source circuit 10, which, in this embodiment, is capable of simultaneously generating plural tone signals through plural channels, receives the melody-related performance data contained in the performance data that are provided via the data and address bus 16 and generates melody-related tone signals based on such received data.

The automatic accompaniment device 11, which, like the tone source circuit 10, is capable of simultaneously generating plural tone signals through plural channels, receives chord-related performance data contained in performance data that are provided via the data and address bus 16 and generates chord-related tone signals based on such received data.

The tone signal generation by the tone source circuit 10 and automatic accompaniment device 11 may be achieved in any method or system selected from among the conventionally-known systems, such as the memory read-out system where tone waveform sample value data stored in an unillustrated waveform memory are sequentially read out by address data that change in accordance with the pitch of a tone to be generated, the FM system where tone waveform sample value data are obtained by execution of a predetermined frequency modulation using the abovementioned address data as phase angle parameter data, or the AM system where tone waveform sample value data are obtained by executing a predetermined amplitude modulation using the above-mentioned address data as phase angle parameter data.

The melody-related tone signal generated by the tone source circuit 10 and the chord-related tone signal generated by the automatic accompaniment device 11 are mixed with each other by a mixing circuit 12 and then audibly reproduced or sounded, via a digital-to-analog converter (DAC) 13 and a sound system (composed of an amplifier and a speaker).

The timer 15 generates pulses for counting predetermined time intervals and tempo clock pulses for establishing an automatic performance tempo. The frequency of the tempo clock pulses can be adjusted by means of an unillustrated tempo switch provided on the panel switch 9. Each of the thus-generated tempo clock pulses is given to the CPU 1 as an interrupt command signal, in accordance with which the CPU 1 carries out various processes for an automatic performance as timer interrupt operations.

In the data and working RAM 3, there are provided groups of registers flags as listed below, which are utilized in the course of various processes to be described later.

X: Root register for storing chord root data indicative of the roots of chords input by the player's performance operation on the keyboard;

TP: Chord type register for storing chord type data indicative of the types of chords input by the player's performance operation on the keyboard;

RUN: Accompaniment state flag that is reversed whenever an automatic performance start/stop switch on the switch panel 9 is actuated. This state flag is set at "1" when an accompaniment performance is running to indicate an accompaniment-running state, and it is set at "0" when an accompaniment performance is not running to indicate an accompaniment-stopped state;

CCLK: Tempo clock counter for an accompaniment (chord) performance;

MCLK: Tempo lock counter for a melody performance;

DF: Identification flag that specifies whether or not a music piece input by the player's performance operation corresponds to any of plural music pieces stored in the memories 4, 5. In this embodiment, performance data of plural (20, for instance) music piece are already stored in the melody performance memory 4 and chord performance memory 5. When a phrase of a desired music piece is performed and input by the player, search is made as to which of the music pieces stored in the memories 4, 5 the input music piece corresponds to. If a specific music piece number of the input music piece has been identified through the search, "1" is set into this identification flag DF, but if not, "0" is et into this flag DF;

i: Variable register that is used to instruct a music piece number in the above-mentioned search operation;

j: Variable register that is used to indicate the total number of the stored music pieces which have been provisionally determined as corresponding to the input music piece data in the above-mentioned search operation. In the search operation, search is made until the value of this register j is reduced to "1";

MCH(i): Coincidence flag that indicates whether or not the input music piece by the player coincides with i-th performance data stored in the melody performance memory 4 and in the chord performance memory 5. This flag is set at "0" when the input music piece coincides with the i-th performance data and is set at "1" when the input music piece does not coincide;

n: Music piece number register for storing data indicative of a music piece number whose performance data should be stored or read out; and NEXT: Next register for storing data indicative of a music piece number whose performance data should be stored or read out when instructions have been given to start a next automatic performance.

In this embodiment of the invention, the melody performance memory 4 is segmented into music piece storage areas MM0–MM19 so as to store therein performance data of 20 music pieces, respectively. Address designation to each music piece storage area MM0–MM19 is done by means of a pointer P. Likewise, the chord performance memory 5 is segmented so as to store therein data of 20 music pieces, respectively. Accordingly, representation MMn (P) in the description below, for example, will indicate the performance data at address P in the n-th music piece storage area MMn for the n-th music piece designated by the music piece number register n, from among the 20 music pieces stored in the melody performance memory 4.

Further, the chord performance memory 5 is segmented so as to store data of 20 music pieces in respective root storage areas RTM0–RTM19 and chord type storage areas TPM0–TPM 19: that is, the memory 5 has separate root storage area RTM0–RTM19 and chord type storage area TPM0–TPM19 for each of the 20 music pieces. Accordingly, representation RTMn (CCLK) in the description below, for example, will indicate the performance data at address CCLK in the n-th chord type storage area TPMn for the n-th music piece, from among the 20 music pieces stored in the chord performance memory 5.

Now, description will be made on various processes carried out by the microcomputer (CPU 1), with reference to the flow charts shown in FIGS. 2 to 8.

Figure 2:
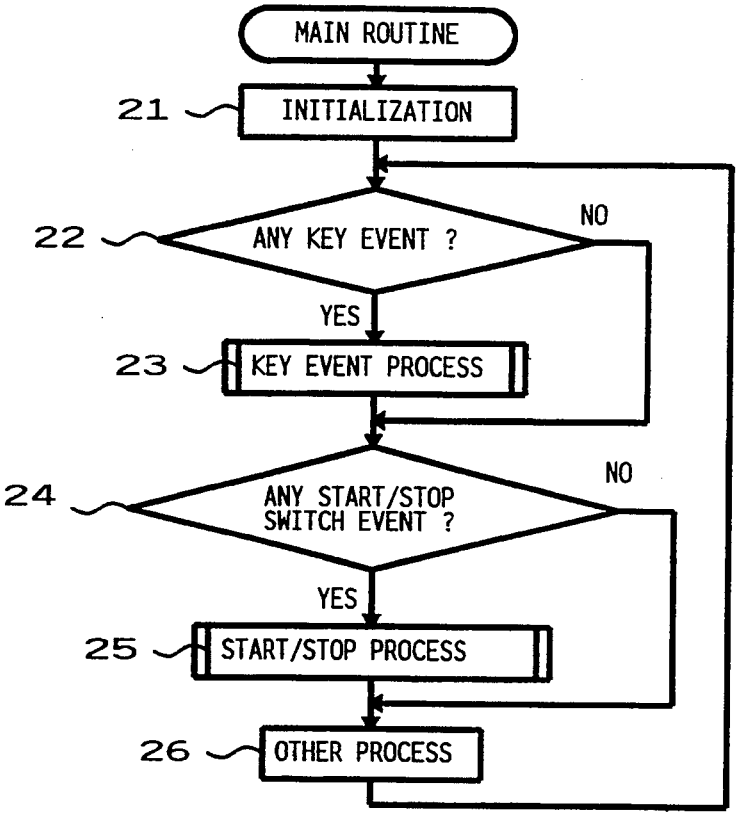
FIG. 2 is a flow chart of a main routine carried out by a microcomputer.

FIG. 2 illustrates an example of the main routine carried out by the microcomputer in the following sequence.

Step 21: In response to switch-on of the power supply, the microcomputer starts an initialization process in accordance with a control program stored in the program ROM 2. In the initialization process, the microcomputer initializes various registers and flags provided in predetermined regions of the data and working RAM 3.

Step 22: The key depression detection circuit 7 is scanned to determine whether or not there is any key event as a result of the player's performance operation of the keyboard 6. If it is determined that there is a key event (i.e., the determination result is YES), the microcomputer proceeds to next step 23. But if there is no key event (i.e., the determination result is NO), the microcomputer jumps to step 24.

Step 23: A key event process is carried out depending upon the type of the key event, as will be described later in detail.

Step 24: The switch operation detection circuit 8 is scanned to determine whether or not there is any switch event as a result of the player's operation of the automatic performance start/stop switch. If it is determined that there is a switch event (i.e., the determination result is YES), the microcomputer proceeds to next step 25. But, if there is no switch event (i.e., the determination result is NO), the microcomputer jumps to step 26.

Step 25: A start/stop process is carried out in response to an on-event of the automatic performance start/stop switch, as will be described in detail later.

Step 26: Other processes are carried out in response to the player's operation of other operators on the switch panel 9. Such other processes includes a tone volume changing process and various processes based on the player's performance operation on the keyboard 6.

Figure 3:
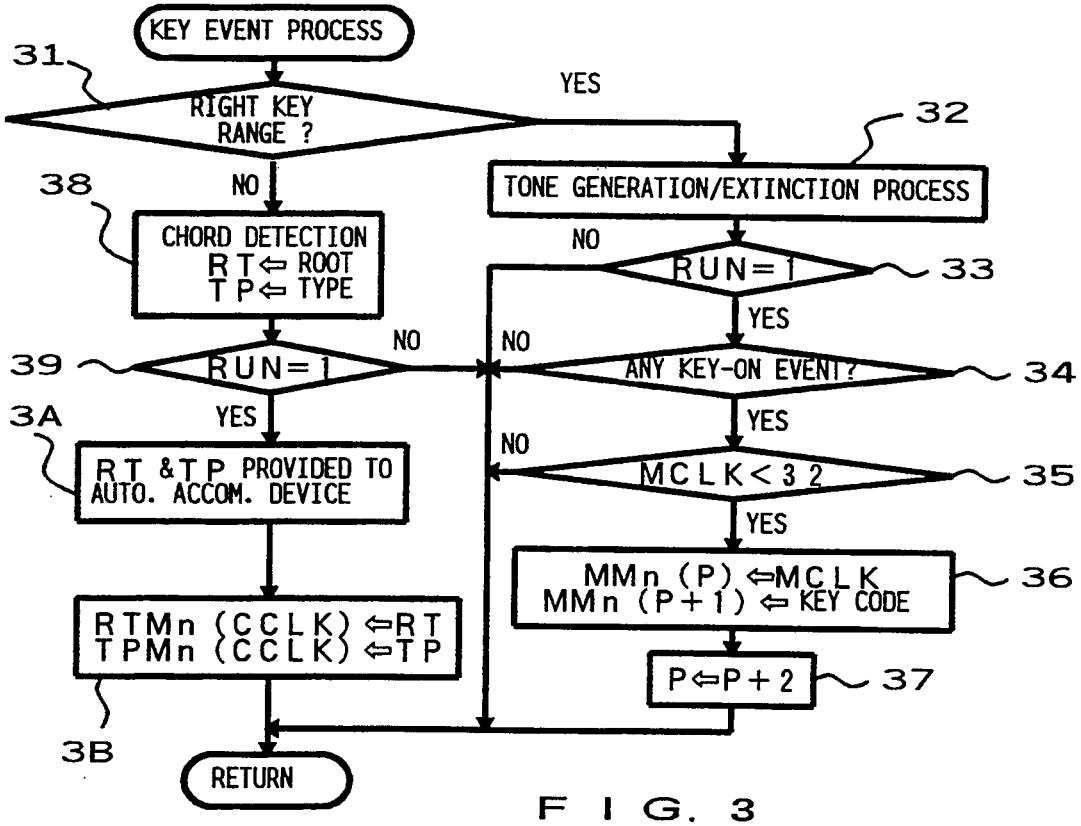
FIG. 3 is a flow chart illustrating the detail of a key event process shown in FIG. 2.

FIG. 3 illustrates in detail the key event process shown in FIG. 2, which is carried out in the following sequence each time the keyboard 6 is operated.

Step 31: It is determined if the operated key on the keyboard 6 is within the right key range. If the operated key is within the right key range (i.e., the determination result is YES), the microcomputer proceeds to step 32. But, if the operated key is within the left key range (i.e., the determination result is NO), the microcomputer proceeds to step 38.

Step 32: Because of the determination in step 31 that the operated key on the keyboard 6 is within the right key range, a tone generation process or a tone extinction process is carried out in accordance with the key code of the operated key.

Step 33: It is determined if the value of the accompaniment state flag RUN is "1" If the flag RUN is "1" (the determination result is YES), the microcomputer goes on to step 34, but if the determination result is NO, then the microcomputer returns to the main routine of FIG. 2. This step is designed for effecting, in the accompaniment-running state, the storage and reproduction of performance data and the search operation according to the present invention.

Step 34: It is determined if the key event is a key-on event. If the determination result is affirmative (YES), the microcomputer proceeds to next step 35, but if the determination result is negative (NO), then the microcomputer returns to the main routine of FIG. 2. That is, in this embodiment, storage of the melody-related performance data is executed only for a key-on event but not for a key-off event.

Step 35: It is determined whether or not the current count of the melody performance tempo clock counter MCLK is smaller than "32". If the current count is smaller than "32" (YES), the microcomputer goes on to next step 36, but if not, then the microcomputer returns to the main routine of FIG. 2. The melody performance tempo clock counter MCLK is a counter for measuring; each performance operation timing, and it is assumed here that the counter MCLK increments its count by 32 for each measure or bar. Therefore, in this embodiment, the melody-related performance data are stored only for one measure, and so when the count of the melody performance tempo clock counter MCLK is equivalent to or greater than 32, no data storage of the melody-related performance data will be executed beyond one measure and the microcomputer will returns.

Step 36: Because of the determination in the respective preceding steps 33, 34 and 35 that an accompaniment is running, there is a key-on event and the timing is within one measure, the count value of the melody performance tempo clock counter MCLK is stored, in order to store the key-on event as melody performance data, into the n-th music piece storage area MMn of the melody performance memory 4 designated by the music piece number register n, at an address location designated by the pointer P, and, likewise, the key code is stored into the n-th music piece storage area MMn at next address location (P+1). Such a system or manner in which the performance data are stored into the melody performance memory 4 is commonly called an "event storage system", where the count value of the melody performance tempo clock counter MCLK indicating the timing of the event occurrence (timing data) and data indicative of the type of the event (key code) are stored, as a set of data, into two address locations.

In this way, the melody-related performance data input via the keyboard are stored, only for one measure, into the n-th music piece storage area MMn as indicated by the register n. The music piece number register n is set in step 43 of FIG. 4 as will be later described.

Step 37: The pointer P is incremented only by "2" in preparation for a next execution of the key event process, and then the microcomputer returns to the main routine of FIG. 2.

Step 38: In response to the determination in step 31 that the operated key falls within the left key range, the microcomputer comes to this step to detect the root and type of a chord based on the key depression on the left key range of the keyboard. Then, the detected root of the chord is stored into the root register AN, and the detected type is stored into the chord type register TP.

Step 39: Determination is made as to if the accompaniment state flag RUN is at "1". If the determination result is affirmative, the microcomputer proceeds to step 3A, but if the determination result is negative, the microcomputer returns to the main routine of FIG. 2.

Step 3A: The contents of the root register and chord type register TP are provided to the automatic accompaniment device 11.

Step 3B: In order to store the detected chord in predetermined locations of the chord performance memory 5, the contents of the root register are stored into the n-th root storage area RTMn of the chord performance memory 5 as indicated by the music piece number n, at an address location indicated by the accompaniment tempo clock counter CCLK, and likewise, the contents of the chord type register TP are stored into the n-th chord type storage area TPMn of the chord performance memory 5 at an address location indicated by the accompaniment tempo clock counter CCLK. After that, the microcomputer returns to the main routine of FIG. 2. Such a system or manner in which performance data are stored into the chord performance memory 5 is commonly called a "full or solid storage system", where an address progression in the memory 5 corresponds to a time progression and performance data on events are sequentially stored at addresses each corresponding to the count value of the accompaniment tempo clock counter CCLK which indicates the timing of the event occurrence.

Figure 4:
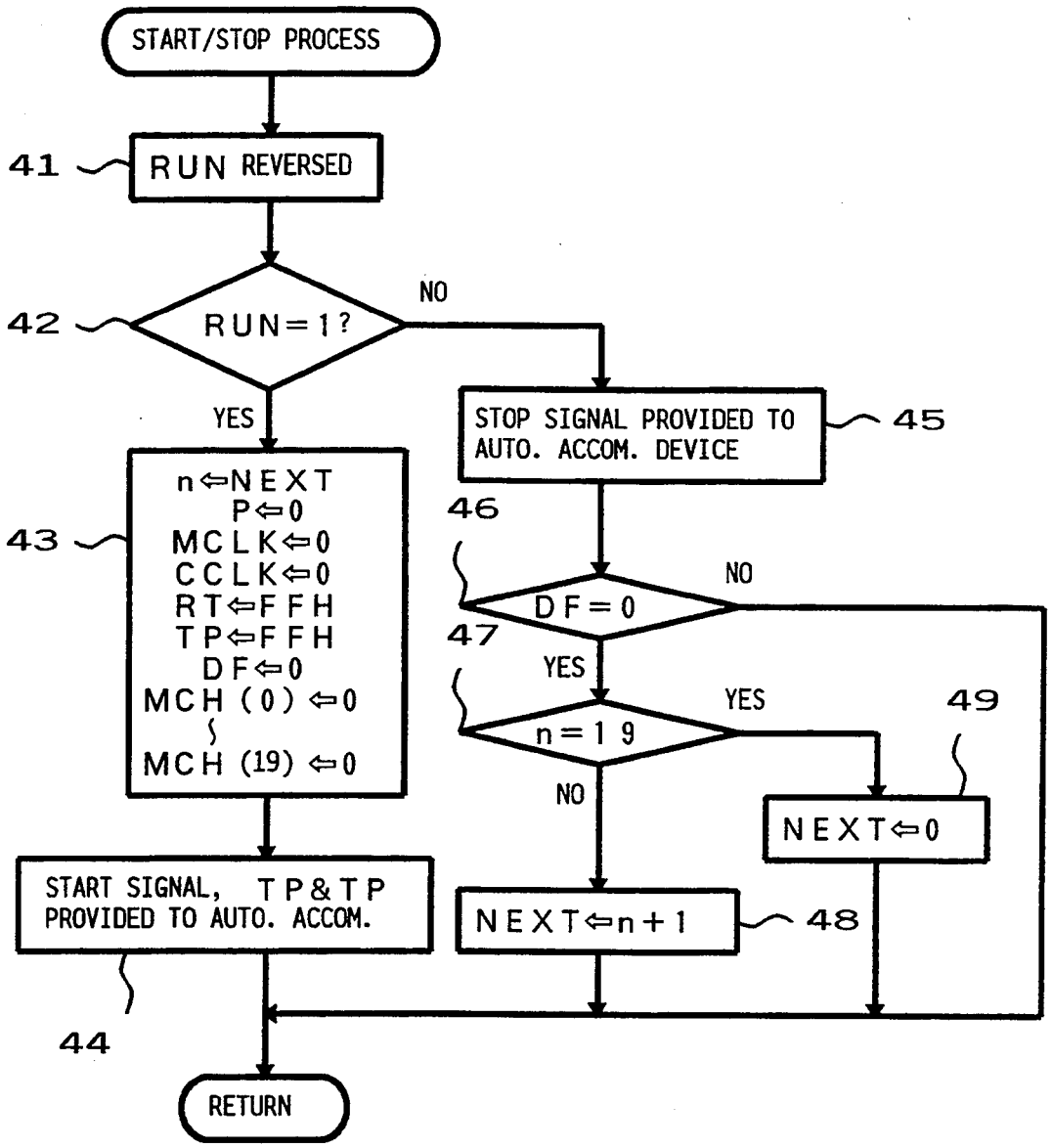
FIG. 4 is a flow chart illustrating the detail of a start/-stop process shown in FIG. 2.

FIG. 4 is a flow chart illustrating in detail the start/-stop process of FIG. 2. This start/stop process is carried out in the following sequence each time the automatic performance start/stop switch on the switch panel 9 is operated or actuated.

Step 41: The contents of the accompaniment state flag RUN are examined. If the state prior to the actuation of the automatic performance start/stop switch is the accompaniment-running state (i.e., the accompaniment state flag RUN is at "1"), the flag RUN is set to "0" so as to bring the subsequent state to the accompaniment-stopping state. Conversely, if the state prior to the actuation of the automatic performance start/stop switch is the accompaniment-stopping state (i.e., the accompaniment state flag RUN is at "0"), the flag RUN is set to "1" so as to bring the subsequent state to the accompaniment-running state.

Step 42: It is determined whether or not the value of the accompaniment state flag reversed in step 41 is "1". If the determination result is "1" (YES), the microcomputer proceeds to next step 43, but if not, the microcomputer branches to step 45.

Step 43: Since the determination in step 42 that the accompaniment state flag RUN is "1" signifies that the state prior to the actuation of the automatic performance start/stop switch was the accompaniment-stopping state, the following initialization process is carried out for the following registers in order to shift the subsequent state to the accompaniment-running state.

First of all, the contents of a next register NEXT indicating a next music piece number are set into a music piece number register n. Each of the pointer P, melody performance tempo clock counter MCLK, accompaniment tempo clock counter CCLK, identification flag DF and coincidence flags MCH(0)–MCH(19) is reset to "0". Then, "FFH" (maximum value in hexadecimal representation) is set into the root register and chord type register TP, in order to indicate that no selection is being made.

Resetting of all the coincidence flags MCH(0)–MCH(19) to "0" is done in order to initialize the flags MCH(0)–MCH(19) into such a state where no coincidence is detected for any of the music pieces.

Step 44: A start signal and the contents of the root register and chord type register TP are provided to the automatic accompaniment device 11.

Step 45: In response to "NO" determination in step 42, the microcomputer comes to step 45. The determination in step 42 that the accompaniment state flag RUN is not at "1" signifies that the state prior to the actuation of the automatic performance start/stop switch was the accompaniment-running state. In this step 45, a stop signal is provided to the automatic accompaniment device 11 in order to shift the subsequent state to the accompaniment-running state.

Step 46: It is determined if the identification flag DF is at "0" If the determination result is "0" (YES), the microcomputer goes to next step 47, but if not, the microcomputer returns to the main routine of FIG. 2.

Step 47: It is determined if the contents of the music piece number register n is "19", i.e., if what has been performed as an automatic accompaniment is the last music piece (20th music piece). If the determination result is negative, the microcomputer goes to next step 48, but if the determination result is affirmative, the microcomputer goes to step 49.

Step 48: Data indicative of a music piece number (n+1) next to the number indicated by the music piece number register n is stored into the next register NEXT, and then the microcomputer returns to the main routine of FIG. 2.

Step 49: "0" is set into the next register NEXT to store data indicative of the first music piece number therein, and the microcomputer returns to the main routine of FIG. 2.

Figure 5:
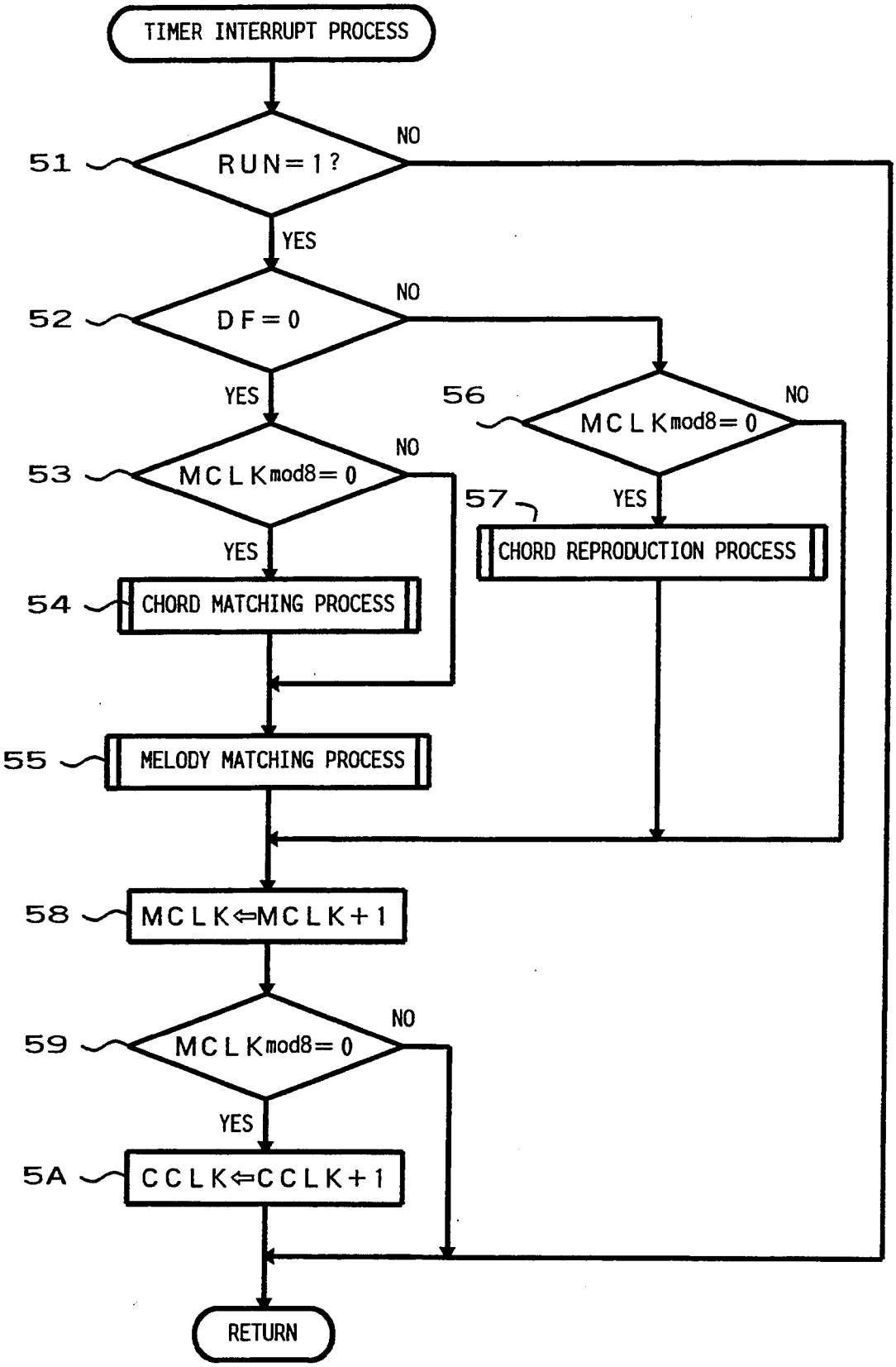
FIG. 5 is a flow chart illustrating the detail of a timer interrupt process that is carried out at the rate of 32 times per measure.

FIG. 5 is a flow chart of a timer interrupt process that is carried out at the rate of 32 times per measure.

Step 51: It is determined if the accompaniment state flag RUN is at "1". If the determination result is "1" (YES), the microcomputer goes to next step 52, but if not, the microcomputer returns to the main routine.

Step 52: It is determined if the identification flag DF is at "0". If the determination result is "0" (YES), it means that the input music piece has not yet been identified and therefore the microcomputer goes to next steps 53–55 to proceed with a chord matching process or a melody matching process. If the determination result is not "0" (NO), it means that the input music piece has been identified, and therefore the microcomputer goes to steps 56 and 57 in order to execute a chord reproduction process.

Step 53: Since the preceding step 52 has determined that the input music piece has not yet been identified, it is further determined whether or not the remainder or modulo obtained from division of the count value of the melody performance tempo clock counter MCLK by 8 (MCLKmod8) is "0", i.e., whether or not the value of the melody performance tempo clock counter MCLK can be divided by 8 without any remainder. If the determination result is affirmative, the microcomputer goes to step 54. If, however, the determination result is negative, then the microcomputer jumps to step 55. Although, as previously mentioned, the timer interrupt process is carried out at the rate of 32 times per measure, this step 53 causes the chord matching process of step 54 to be carried out at the rate of four times per measure, namely, once for each quarter note. As compared to this, the melody matching process of step 55 is executed at a rate of 32 times per measure, namely, once for each thirty-second note.

Step 54: The chord matching process is carried out to search the chord performance memory 5 for such performance data that indicates a same chord progression as that designated during the player's performance operation using the left key range. This chord matching process will be described in detail later.

Step 55: The melody matching process is carried out to search the melody performance memory 4 for such performance data that indicates a same melody progression as that designated during the player's performance operation using the right key range. This melody matching process will be described in detail later.

Step 56: Since the preceding step 52 has determined that the input music piece has been identified, it is then determined whether or not the remainder or modulo obtained from division of the count value of the melody performance tempo clock counter MCLK by 8 (MCLKmod8) is "0". Only in the case where the determination result is affirmative (that is, for each quarter note), the microcomputer goes to step 57 in order to carry out the chord reproduction process for the input music piece identified. If, however, the determination result is negative, then the microcomputer jumps to step 58.

Step 57: The chord reproduction process is carried out for the input music piece which has been identified through the chord matching process or the melody matching process. This chord reproduction process will be described in detail later.

Step 58: The melody performance tempo clock counter MCLK is incremented by 1. This causes the melody performance tempo clock counter MCLK to increment its count by 32 for each measure.

Step 59: It is determined whether or not the remainder or modulo obtained from division of the count value of the melody performance tempo clock counter MCLK by 8 (MCLKmod8) is "0". Only when the determination result is affirmative (that is, for each quarter note), the microcomputer goes to next step 5A, but if not, the microcomputer returns to the main routine.

Step 5A: The accompaniment tempo clock counter CCLK is incremented by 1. This causes the accompaniment tempo clock counter CCLK to increment it count by 4 for each measure.

Figure 6:
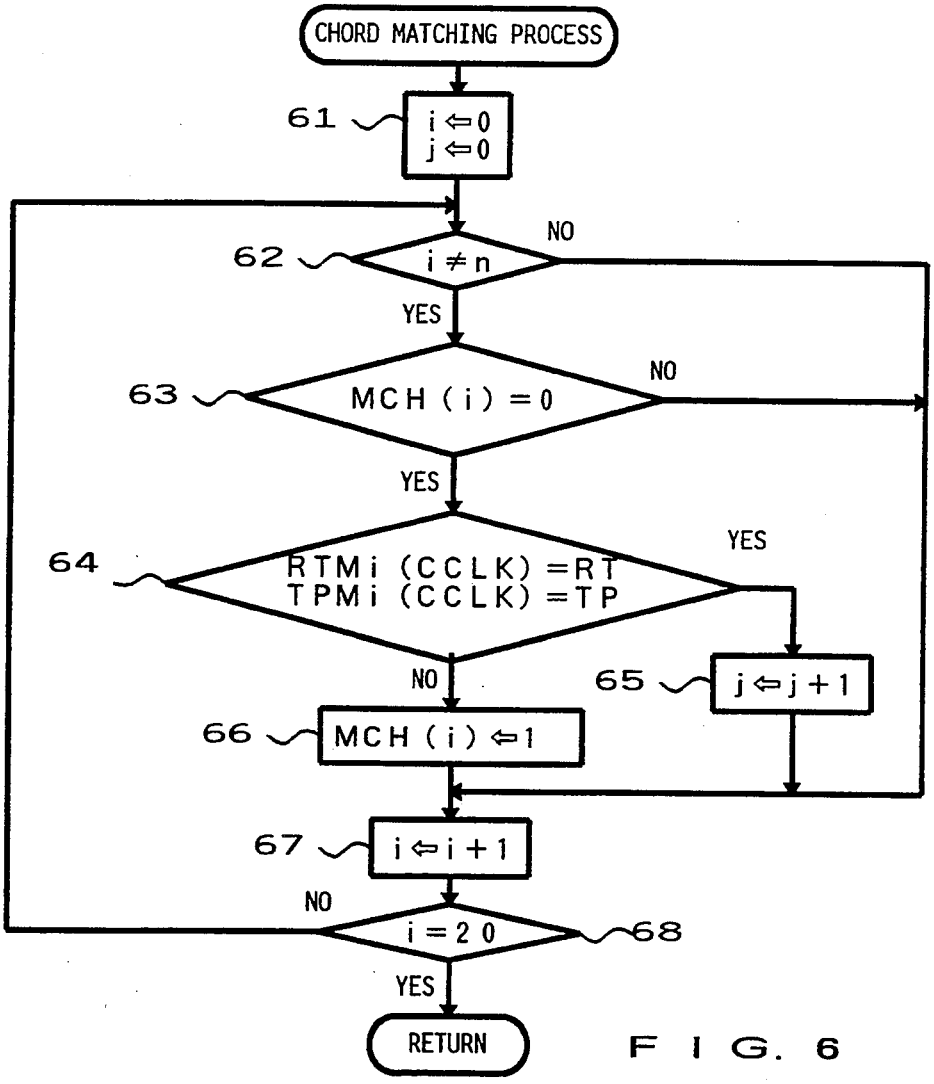
FIG. 6 is a flow chart illustrating the detail of a chord matching process shown in FIG. 5.

FIG. 6 illustrates the detail of the chord matching process of step 54 of FIG. 5. The chord matching process is designed for sequentially comparing the chord data of the input music piece and the respective chord data of the 20 music pieces stored in the chord performance memory 5 and for then setting "1" into the coincidence flag MCH(i) that corresponds to the stored music piece whose chord progression is determined as not matching or coinciding with that of the input music piece. This chord matching process is carried out in the following sequence.

Step 61: The variable register i is reset to "0".

Step 62: It is determined whether or not the value of the variable register i is different from the value of the music piece number register n. If the determination result is "different" (YES), the microcomputer goes to next step 63, but if "not different" (NO), the microcomputer jumps to step 67. That is, in the event that the values of the variable register i and music piece number register n are the same, unnecessary comparison will be made with the same performance data as the input performance data which are stored in the n-th root storage area RTMn and chord type storage area TPMn, although it is obvious that the two performance data will coincide with each other. To avoid such unnecessary performance data comparisons, comparison is made in this step between the variable register i and the music piece number register n.

Step 63: Determination is made as to whether the coincidence flag MCH(i) is "0" If the determination result is YES, the microcomputer goes to next step 64, but if not, the microcomputer jumps to step 67. Since each flag MCh(i) is initialized at "0" in the first stage, "YES" determination is made in this step 63 for each "i" and then the microcomputer goes to next step 64, in which determination is made as to whether the performance data stored in the n-th are coincident with the performance data of the i-th music piece. Once "not-coincidence" determination has been made for the i-th music piece, MCH(i) is set at "1" through step 66 of FIG. 6 and step 77 of FIG. 7. So, "NO" determination is obtained in this step 63, and the microcomputer jumps to step 67 so as not to execute the coincidence determination. That is, such a music piece number having been once determined as "not coincident" is no longer considered as an object for the search operation.

Step 64: Determination is made as to whether the root data that is stored in the i-th root storage area RTMi of the chord performance memory 5 at an address location designated by the accompaniment tempo clock counter CCLK (the performance data of the i-th music piece) is coincident with the root data stored in the root register AMI (the input performance data), and also as to whether the chord type data that is stored in the i-th chord type storage area TPMi of the chord performance memory 5 at an address location designated by the accompaniment tempo clock counter CCLK (the performance data of the i-th music piece) is coincident with the chord type data stored in the chord type register TP (the input performance data). If the determination result is YES, i.e., if a "coincidence" has been confirmed for both the root and the chord type, the microcomputer goes to step 65, but if not, the microcomputer goes to step 66.

Step 65: The variable register j is incremented by "1" Namely, in this step, the number of music pieces for which coincidence has been determined in step 64 is stored into the variable register j.

Step 66: Because of "non-coincidence" determination in step 64, "1" is set into the coincidence flag MCH(i).

Step 67: The variable register i is incremented by "1" to add to the music piece number in the chord performance memory 5.

Step 68: It is determined if the value in the variable register i is "19", i.e., if the last (20th) music piece has been reached. If the determination result is YES, the microcomputer goes to step 55 of FIG. 5, but if not, the microcomputer goes back to step 62.

Figure 7:
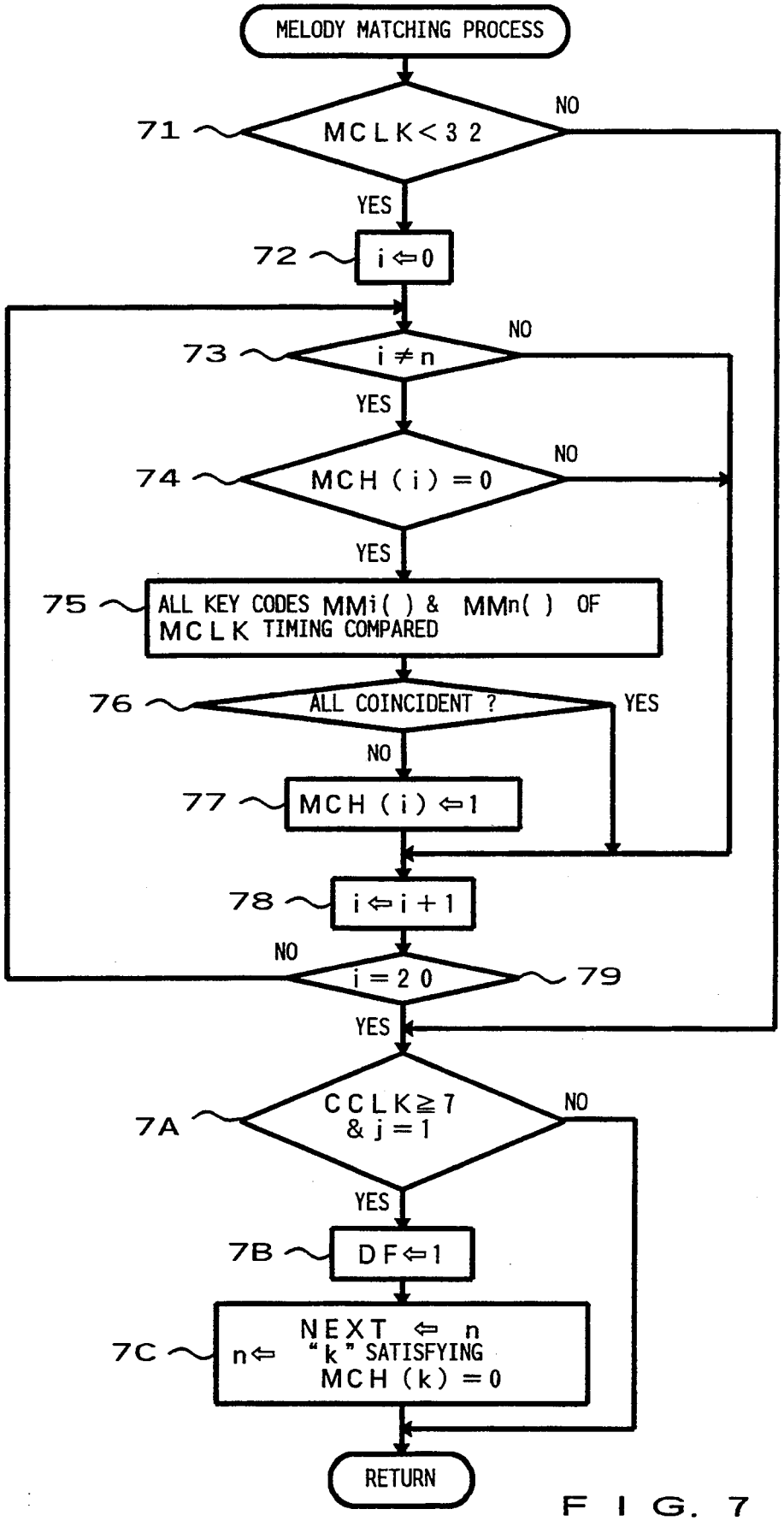
FIG. 7 is a flow chart illustrating the detail of a melody matching process shown in FIG. 5.

FIG. 7 is a flow chart illustrating the detail of the melody matching process of FIG. 5. This melody matching progress sequentially compares the performance data of the input music piece with the respective performance data of the 20 music pieces stored in the melody performance memory 4, starting with the first music piece. "1" is set into the coincidence flag MCH(i) corresponding to the music piece number whose performance data has not matched or coincided with that of the input music piece. This melody matching process is carried out in the following sequence.

Step 71: Determination is made as to whether the current count of the melody performance tempo clock counter MCLK is smaller than "32" If the determination result is affirmative, the microcomputer goes to next step 72, but if not, the microcomputer jumps to step 7A. Because the count "32" of the counter MCLK corresponds to one measure, this step is taken in order to carry out the melody matching process for only first one measure but not for the following measures. This is because the melody matching process lasting for a longer period (longer than one measure) will result in a reduced coincidence rate, so that it will become difficult to search for a music piece number having performance data coincident with that of the input music piece. The value "32" used for this step is only an example, and a greater or smaller value may of course be used.

Step 72: The variable register i is reset to "0"

Step 73: In a similar manner to the above-mentioned step 62, determination is made as to whether the value in the variable register i is different from the value in the music piece number register n. If the determination result is "different" (YES), the microcomputer goes to step 74, but if the determination result is "same" (NO), the microcomputer jumps to step 79.

Step 74: In a similar manner to the above-mentioned step 63, determination is made as to whether the coincidence flag MCH(i) is "0". If the determination result is YES, the microcomputer goes to next step 75, but if not, the microcomputer jumps to step 79.

Step 75: Comparison is made between each key code stored the i-th music piece storage area MMi of the melody performance memory 4 which has the same timing data as the value of the melody performance tempo clock counter MCLK (the performance data of the i-th music piece), and each key code stored in the n-th music piece storage area MMn which has the same timing data as the value of the melody performance tempo clock counter MCLK (the input performance data).

Step 76: Based on the comparison result in step 75, it is determined if the key codes in the i-th and n-th music piece storage areas are all coincident with each other. If the determination result is "all coincident" (YES), the microcomputer goes to step 78, but if the result is "not all coincident" (NO), the microcomputer goes to step 77.

Step 77: Because of the "non all coincident" determination in step 76, "1" is set into the coincidence flag MCH(i) in a similar manner to the foregoing step 66.

Step 78: The variable register i is incremented by "1" to add to the music piece number in the melody performance memory 4.

Step 79: It is determined if the current value in the variable register i is "19", i.e., if the last (20th) music piece has been reached. If the determination result is YES, the microcomputer goes to step 7B, but if not, the microcomputer goes back to step 73.

Step 7A: Determination is made as to whether the value in the accompaniment tempo clock counter CCLK is equivalent to or greater than "7" and the value in the variable register j is "1". If the determination result is YES, the microcomputer goes to step 7B, but if not, the microcomputer goes to step 58 of FIG. 5. The "YES" determination result in this step is obtained in such a case where the chord matching process of FIG. 6 is carried out for two or more measures (i.e., until the accompaniment tempo clock counter CCLK reaches a value of "7") and only one performance data having the same chord progression as that made by the player has been identified, through the chord matching process, from among the performance data in the chord performance memory 5.

Step 7B: Now that, in the last step 7A, the chord matching process of FIG. 6 has been carried out for two or more measures and identification has been made of only one performance data in the chord performance memory 5 which has the same chord progression as that made by the player, "1" is set into the identification flag DF.

Step 7C: The contents of the music piece number register n is stored into the next register NEXT, and then the music piece number k corresponding to a single coincidence flag MCH(k)whose value has become "0" is stored into the music piece number n. k is data indicative of the searched-out or identified music piece number and is not the same as the value n stored in the next register NEXT. At this time, a suitable display (by lamp, sound etc.) may be made for informing the player that the search has been completed, or the searched-out music piece number k may be displayed.

Therefore, in the case where there has been detected no performance data having the same chord progression as that made by the player after the lapse of time corresponding to two measures (the value stored in the variable register j is "0", the flag DF is no longer set at "1" and only the process for storing the input performance data by the key event process of FIG. 3 into the n-th area is continued. On the other hand, in the case where there have been detected a plurality of performance data having the same chord progression as that made by the player after the lapse of time corresponding to two measures (the value of the variable register j is equivalent to or greater than "2"), the chord matching process is carried out until the value of the variable register j becomes "1".

Figure 8:
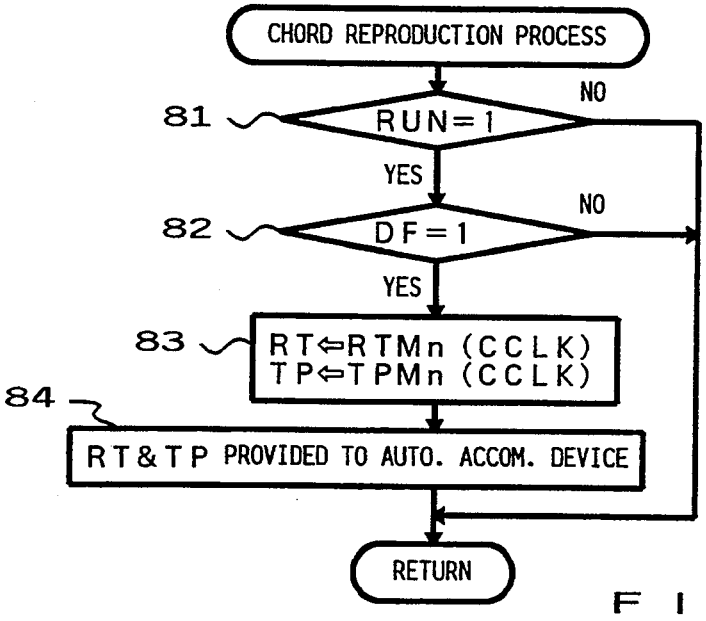
FIG. 8 is a flow chart illustrating the detail of a chord reproduction process shown in FIG. 5.

FIG. 8 is a flow chart illustrating the detail of the chord reproduction process shown in FIG. 5, which is carried out in the following sequence.

Step 81: It is determined whether or not the value in the accompaniment state flag RUN is "1". If it is "1" (YES), the microcomputer goes to a next step, but if not, the microcomputer goes to step 58 shown in FIG. 5.

Step 82: Determination is made as to whether the value in the identification flag DF is "1". If it is "1" (YES), the microcomputer goes to next step 83, but if not, the microcomputer goes to step 58 shown in FIG. 5.

Step 83: The root data that is stored in the n-th root storage area RTMn of the chord performance memory 5 at an address location designated by the accompaniment tempo clock counter CCLK is stored into the root register , and also, the chord type data that is stored in the n-th chord type storage area TPMn of the chord performance memory 5 at an address location designated by the accompaniment tempo clock counter CCLK is stored into the chord type register TP.

Step 84: To the automatic accompaniment device 11 are provided the root data stored in the root register as well as the chord type data stored in the chord type register TP. The automatic accompaniment device 11 executes a desired automatic performance (for example, auto bass chord performance) on the basis of the provided root data and chord type data.

Next, the overall operation of the embodiment will be described by way of example with reference to the flow charts of FIGS. 2 to 8.

It is assumed that when the accompaniment state flag RUN is at the value of "0", the player or operator has actuated the automatic performance start/stop switch to start performing, on the keyboard 6, a music piece corresponding to music piece No. 3.

First, the presence of the start/switch event is detected in step 24 of FIG. 2, so that the start/stop process of FIG. 4 is executed in step 25. In step 41 of the start/-stop process, the value of the accompaniment state flag RUN is reversed to be set to "1". Thus, the determination result in step 42 becomes YES, so that steps 43 and 44 are executed. In step 43, a value of the next register NEXT (for example "15") is stored into the music piece register n.

After that, the key event process of FIG. 3 and the timer interrupt process of FIG. 5 are carried out in response to the player's performance operation on the keyboard 6.

In the key event process of FIG. 3, the root data and chord type data of each chord performed by the player using the left key range of the keyboard 6 are detected and stored respectively into the root register and chord type register TP and also into the 15th root storage area RTM15 and 15th chord type storage area TPM15 of the chord performance memory 5 at their address locations (address 0) designated by the accompaniment tempo clock counter CCLK (=0). In a similar manner, the key-on timing data and key code of each melody note performed by the player using the right range of the keyboard 6 are stored into the 15th music piece storage area MM15 of the melody performance memory 4 at two adjoining address locations (addresses 0 and 1) designated by the pointer P.

In the timer interrupt process of FIG. 5, the chord matching process of FIG. 6 and the melody matching process of FIG. 7 are carried out in steps 54 and 55, respectively, depending upon the determination result in steps 51 to 53.

In the chord matching process of FIG. 6, determination is made as to whether or not the root data and chord type data which are stored in the i-th (i is indicative of 0–14 and 16–15) root storage area RTMi and i-th chord type storage area TPMi of the chord performance memory 5 at their address locations (address 0) designated by the accompaniment tempo clock counter CCLK (=0) are coincident with the contents of the root register and chord type register TP, respectively. If they are not coincident (NO), "1" is set into the coincidence flag MCH(i) (step 66). On the other hand, if they are coincident (YES), the value of the variable register j is incremented (step 65).

In the melody matching process of FIG. 7, comparison is made between key code stored in the i-th (i is indicative of 0–14 and 16–19) of the melody performance memory 4 which has the timing data corresponding to the value of the melody performance tempo clock counter MCLK, and key code stored in the 15th music piece storage area MM15 which has the timing data corresponding to the value of the melody performance tempo clock counter MCLK. If they are not coincident (NO), "1" is set into the coincidence flag MCH(i).

The matching processes of FIGS. 6 and 7 are repeatedly executed for one measure to detect each music piece number for which the coincidence flag MCH(i) has been set at "0" Then, the chord matching process of FIG. 6 alone is further executed for next one measure. Subsequently, when the first two measures have ended, the determination in step 7A of FIG. 7 is executed.

Thus, if the value in the variable register j is "1" in step 7A, then it is determined that music piece No. 3 is currently being performed on the keyboard 6, so that "1" is set into the identification flag DF, "15" is loaded into the next register NEXT, and also k obtained in the case where the coincidence register MCH(k) is "0", namely, "3" is loaded into the music piece number n. After that, the key event process of FIG. 3 and steps 51, 52 and 56 to 5A of the timer interrupt process of FIG. 5 will be carried out in a repeated manner. Accordingly, through the chord reproduction process of FIG. 8, the root data and chord type data will be read out from the third root storage area RTM3 and third chord type storage area TPM3 of the chord performance memory 5 and provided to the automatic accompaniment device 11, in such a manner that a chord performance will henceforth be carried out in an automatic fashion.

If the value in the variable register j is "0" at the end of the first two measures, it means that the music piece being performed on the keyboard 6 has not been found in the performance memory, and so the performance data resultant from the key event process of FIG. 3 are sequentially stored, as new music piece data, into the 15th root storage area RTM and 15th chord type storage area of the chord performance memory 5.

If the value in the variable register j is "2" or more at the end of the first two measures, it means that although a music piece corresponding to the music piece being performed on the keyboard 6 is stored in the performance memory, identification has not yet been made as to which music piece stored in the performance memory the music piece being performed corresponds to, and so the chord matching process of FIG. 6 is executed until the value of the variable register 1 becomes "1".

In the case where the automatic accompaniment is stopped without the music piece input by the performance operation on the keyboard being identified from among those stored in the performance memory, i.e., where the input performance data has been written into storage areas for the music piece number n indicated by the music piece number n, the condition DF=0 is obtained, so that a music piece number next to the number n for which performance data has been written (n+1, or 0) is stored into the next register NEXT by executing step 48 (or 49) after "YES" determination in step 46 of FIG. 4. In such a case, when an automatic performance is started next time, the music piece number next to the number n for which performance data was stored last time is indicated by the music piece number n, through the process in step 43 of FIG. 4 for setting the value of the register NEXT into the register n. Accordingly, when new performance data has been written, the storage areas for storing the input performance data are changed to next ones. In response to this, the newly written performance data is allotted a specific music piece number and then such data is preserved.

On the other hand, in the case where the music piece input by the performance operation on the keyboard is identified from among those stored in the performance memory, the value of the music piece number register n indicating the music piece number with which the performance data input at this time is stored is set into the next register NEXT through step 7C of FIG. 7. Then the searched-out or identified music piece number k is set into the music piece number register n. In this case, as previously mentioned, the automatic performance data (chord data) of the searched-out music piece number set into the register n are then read out from the performance memory 5, on the basis of which an automatic accompaniment is performed. When the automatic performance is subsequently stopped, DF=1 and "NO" determination is obtained in step 46 of FIG. 4, so that steps 48 and 49 are not executed. Therefore, when an automatic accompaniment is again started later, the same music piece number as the music piece number for which performance data was stored last time is indicated by the music piece number n, through the process in step 43 of FIG. 4 for setting the value of the register NEXT into the register n. Accordingly, when already stored performance data has been read out for reproduction, storage areas (for music piece number n) for storing the input performance data from the keyboard is not changed. Because of this, input performance data corresponding to performance data already stored in certain storage areas is not preserved.

The operation of the foregoing embodiment will be summarized. When the player simply performs a leading phrase of a desired music piece on the keyboard, without making any particular switch operation for instructing write or readout of automatic performance information, the device automatically judges whether performance data should be read out for reproduction or written. Namely, if the input performance data from the keyboard corresponds to a music piece already stored in the memory, as soon as the already stored music piece has been searched out, namely, as soon as the flag DF has been set at "1", the device is automatically brought into a state for reading out the searched-out stored music piece for reproduction. On the other hand, in the case where new performance data should be written, the performance data can be automatically stored into the memory as the player performs and input desired performance data via the keyboard. That is, in this case, it is not detected that the same performance data is already stored, so that the device is not brought the state for reproductive readout and the input performance data is sequentially stored into the memory.

The embodiment has been described so far as being applied to an automatic accompaniment device, where melody-related performance data are stored only for one measure and utilized only for the purpose of searching out a music piece number with which desired automatic accompaniment data (chord data) are stored. In such an example, both melody performance and chord performance are manually done at first. But, after a stored music piece number corresponding thereto has been searched out, the player only has to manually make melody performance because already stored performance data are read out for reproducing the accompaniment performance (chord performance). Consequently, in such a case where the player exercises only manual melody performance in a repeated manner, a considerable degree of convenience may be provided because the accompaniment (chord) performance can be fully automated. Besides, without the need for selecting a music piece number with which accompaniment performance data are stored and for an operation to instruct a start of reproductive readout of the accompaniment performance data, the music piece number can be automatically selected and the reproductive readout state is brought.

The above-mentioned embodiment can be modified in such a manner that the entire sequence of melody performance is stored and automatically reproduced. To this end, it is sufficient that step 25 of FIG. 3 is omitted and a "melody reproduction process" routine is inserted in the "NO" route of step 52 in FIG. 52. In this "melody reproduction process" routine, each key code having timing data corresponding to the value of the counter MCLK is read out from the n-th storage area MMn of the melody performance memory 4 indicated by the music piece number register n so that a tone signal corresponding to the read-out key code is generated from the tone source circuit 10.

What is claimed is:

1. An automatic performance device comprising:

storage means having a plurality of storage areas, each of the storage areas storing a series of performance data corresponding to a music piece, thereby said storage means being capable of storing performance data of plural music pieces:

input means for inputting desired performance data:

write-control means for controlling write of the performance data input by said input means, into a first storage area of said storage means;

search means for making a comparison between the performance data already stored in storage areas of said storage means other than said first storage area and the input performance data, in order to detect whether or not performance data of a music piece corresponding to the input performance data are already stored in said storage means, and also for detecting, on the basis of the result of the comparison, a second storage area of said storage means where performance data of a music piece corresponding to the input performance data are stored; and performance control means for, if said second storage area has been detected, sequentially reading out a series of performance data from said second storage area.

2. An automatic performance device as defined in claim 1 further comprising preservation control means for preserving, as performance data of a new music piece, the performance data stored in said first storage area if the second storage area has not been detected by said search means, and for not preserving the performance data stored in said first storage area if said second storage area has been detected.

3. An automatic performance device as defined in claim 1 wherein said storage means stores performance data relating to a chord performance.

4. An automatic performance device as defined in claim 1 wherein said storage means stores performance data relating to a melody performance.

5. An automatic performance device as defined in claim 1 wherein each of the plural storage areas of said storage means is composed of a pair of storage portions for separately storing a series of chord performance data and a series of melody performance data for a same music piece, said input means is capable of inputting, as the performance data, chord performance data and melody performance data in a separate manner so that the input chord performance data and melody performance data are stored separately into the pair of the storage portions of said first storage area, and said search means includes a first comparison means for making said comparison for the chord performance data and a second comparison means for making said comparison for the melody performance data, and said search means detects the second storage area that stores therein performance data of a music piece corresponding to both of the input chord performance data and melody performance data on the basis of the comparisons by said first and second comparison means.

6. An automatic performance device as defined in claim 5 wherein data corresponding a partial phrase of each of the music pieces are stored in said storage means with respect to the melody performance data, and said performance control means makes a reproductive performance by reading out the chord performance data stored in said the second storage area.

7. An automatic performance device as defined in claim 6 further comprising automatic accompaniment means for making an automatic accompaniment performance on the basis of the chord performance data read out by said performance control means.

* * * * *